United States Patent [19]

Begneaud

[11] Patent Number: 4,467,489

[45] Date of Patent: Aug. 28, 1984

[54] PORTABLE DRILL PIPE CLEANING APPARATUS

[76] Inventor: Donald M. Begneaud, 218 Supply Rd., Lafayette, La. 70506

[21] Appl. No.: 360,602

[22] Filed: Mar. 22, 1982

[51] Int. Cl.[3] ..... B08B 9/02

[52] U.S. Cl. ..... 15/88; 15/22 R; 15/104.04

[58] Field of Search ..... 15/104.03, 104.04, 104.05, 15/88, 22 R, 75, 76; 134/6

[56] References Cited

U.S. PATENT DOCUMENTS

| | | | |
|---|---|---|---|
| 3,922,890 | 12/1975 | Shibata | 15/76 |
| 4,011,617 | 3/1977 | Toelke et al. | 15/88 |
| 4,014,062 | 3/1977 | Scott et al. | 15/104.04 |
| 4,372,003 | 2/1983 | Toelke | 15/88 |

*Primary Examiner*—Edward L. Roberts
*Attorney, Agent, or Firm*—Charles C. Garvey, Jr.

[57] ABSTRACT

A power brush for cleaning drill pipe is disclosed utilizing a rotary gun having a rotary power shaft, a handle for gripping the gun and approximately located trigger for actuating the shaft to rotate. A circular baffle plate is mounted securedly to the gun and provides an opening through which the rotary shaft passes during operation with some clearance thus allowing rotation of the shaft with respect to the plate. A cylindrical shroud is affixed to the periphery of the baffle plate forming a closed end portion of the shroud adjacent the gun, the opposite end of the shroud being an open ended portion thereof. A brush carriage is mounted securedly yet removably to the shaft for rotation therewith, the carriage providing a generally circular hub having a hub opening through which the shaft passes and then attaches during operation. A plurality of inwardly facing channels are securedly and equi-radially affixed about the periphery of the hub and are mounted at one end of the channel to the hub projecting outwardly therefrom along the line which eventually intersects the axis of the shaft. Each of the channels carries a wire brush having a plurality of projecting bristles spaced along the length thereof with the bristles of each of the brushes secured within the channels registering with the threads of the drill pipe being cleaned.

11 Claims, 11 Drawing Figures

PORTABLE DRILL PIPE CLEANING APPARATUS

BACKGROUND OF THE INVENTION

1. Field of the Invention

The present invention relates to the use of powered bristles to clean drill pipe and the like using wire bristles. Even more particularly, the present invention relates to a hand held power brush unit which provides angularly disposed bristles to clean both the thread and facing of oilfield drill pipe while dispensing cleaning fluid thereto.

2. General Background

In the oil and gas industry, it is known to use various lengths of pipe known as drill pipe which are connected together section to section. Also, production tubing and casing is connected end to end in the oil and gas industry.

Usually the connecting together of drill pipe, casing, and the like is done by means of threaded connections with each of the joints of pipe having an externally threaded pin end portion and an internally threaded "box" end portion with the pin connection connecting to the box connection as is known in the art.

These joints of drill pipe need to be cleaned from time to time of rust, scale, drilling mud and the like. The cleaning of this drill pipe requires a set of bristles which are rotary in nature being faced inwardly or outwardly to clean the pin and box connections respectively.

Power brushes to clean the threads of drill pipe per say are known, with the majority of devices being arkward or bulky, requiring multiple operators to handle them or having complex arrangements for clamping the brushes which provides maintenance problems and lost down time and the like.

3. General Discussion of the Present Invention

The present invention solves these problems and shortcomings in a simple, straightforward fashion by providing a power brush apparatus for cleaning pipe threads. The apparatus of the present invention can be operated by a single individual having places for the gripping of the tool in such a manner that the operator can actuate both the power to the bristles for rotating them in a manner which cleans the thread and at the same time with the other hand can dispense cleaning fluid into the threads to be cleaned and these two operations can be done independently of one another.

The present invention provides a rotary power brush having a rotary gun which provides a shaft, a handle for gripping the gun, and a trigger located approximately to the handle for actuating rotation of the shaft. A circular baffle plate is mounted securedly with respect to the gun and provides an opening therethrough through which the rotary shaft passes during operation with some clearance allowing rotation of the shaft with respect to the baffle plate. A cylindrical shroud having affixation by welding, for example, to the periphery of the baffle plate is provided and forms with the baffle plate a closed end portion of the shroud adjacent the gun. The opposite end portion of the shroud is normally open. A handle is affixed to the shroud with a valve being mounted on the handle and being receptive of a supply of flowing cleaning fluid which is dispensed into the interior of the shroud through the valve. A flexible rubber-like closure is removably placed over the shroud open end portion with the closure having a central opening through which the threaded end of a joint of pipe to be cleaned can pass, with the opening approximating the outer diameter of the joint of pipe and attempting to form a seal thereabout to retain as much cleaning fluid within the shroud as possible as the fluid is dispensed into the valve. The rubber-like closure prevents loss of cleaning fluid as the device is operated due to splashing out the open end portion of the shroud.

A brush carriage is mounted securedly yet removably on the shaft for rotation therewith, the carriage comprising a generally circular hub having a hub opening to which the shaft attaches during operation thus allowing the brush carriage to rotate with respect to the shroud and the power gun. A plurality of inwardly facing channels are secured equi-radially about the hub at the periphery of the hub and are mounted at one end of the channel to the hub and project outwardly therefrom along a line which eventually intersects the axis of the shaft. Each of the channels carries a wire brush having a plurality of projecting bristles which are spaced along the length thereof with each of the channels being angularly supported with respect to the axis of the shaft and the bristles of each of the brushes thus being secured within the channels registering with the threads of the drill pipe being cleaned.

It is thus an object of the present invention to provide a power brush cleaning apparatus which can be manipulated by a single operator individual.

Another object of the present invention is to provide a power brush apparatus in which the power supply and brush carriage are in a single hand held unit.

Another object of the present invention is to provide a power brush unit having a brush carriage configuration which maximizes the number of brushes being carried and thus the cleaning action on the threads.

Another object of the present invention is to provide a power brush apparatus which cleans drill pipe threads including both the threads and the facing.

Another object of the present invention is to provide an apparatus for cleaning drill pipe threaded end portions thereof including both the box and pin connections.

Another object of the present invention is to provide a cleaning apparatus for cleaning drill pipe threaded connections which in combination supplies a cleaning fluid to the bristles which clean the drill pipe during the cleaning operation in a controlled fashion.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
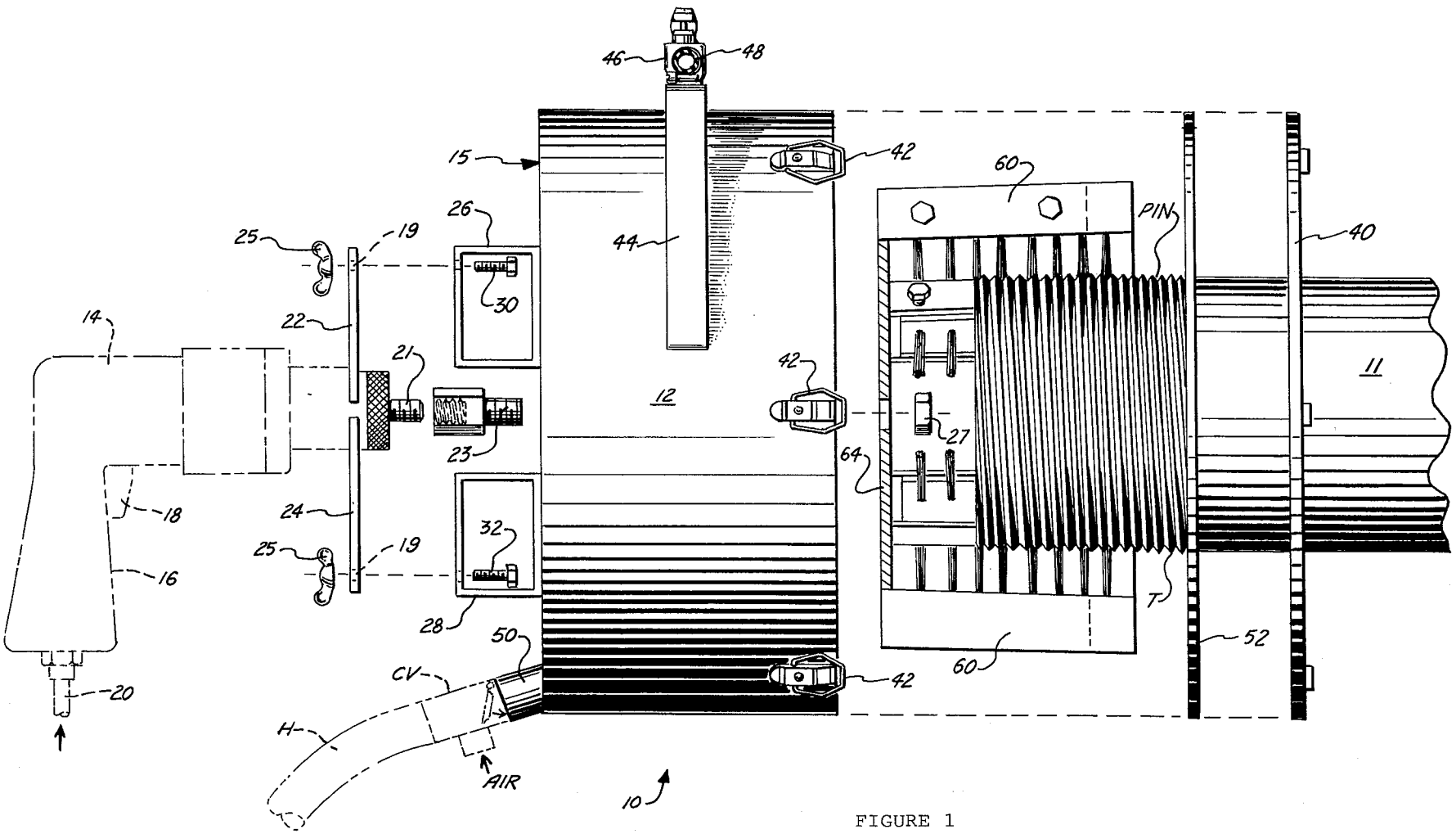
FIG. 1 is an exploded side view of the preferred embodiment of the apparatus of the present invention.

FIG. 1 illustrates the preferred embodiment of the apparatus of the present invention designated generally by the numeral 10.

Power brush 10 provides a shroud or casing 12 to which is attached a power supply such as an air operated gun 14 having a handle 16 and trigger 18 portions thereof. An air source connection 20 allows pneumatic pressure to be connected to the gun which when the trigger is activated transmits rotary power to shaft 21 and shaft extension 23.

A pair of mounting flanges 22, 24 are rigidly affixed to gun 14 by welding or like means, with a pair of wing nuts 25 attaching gun 14 to mounting brackets 26, 28 of shroud 12 using mounting bolts 30, 32, for example. This provides a secure connection between gun 14 and shroud 12 as is desired.

Figure 2:
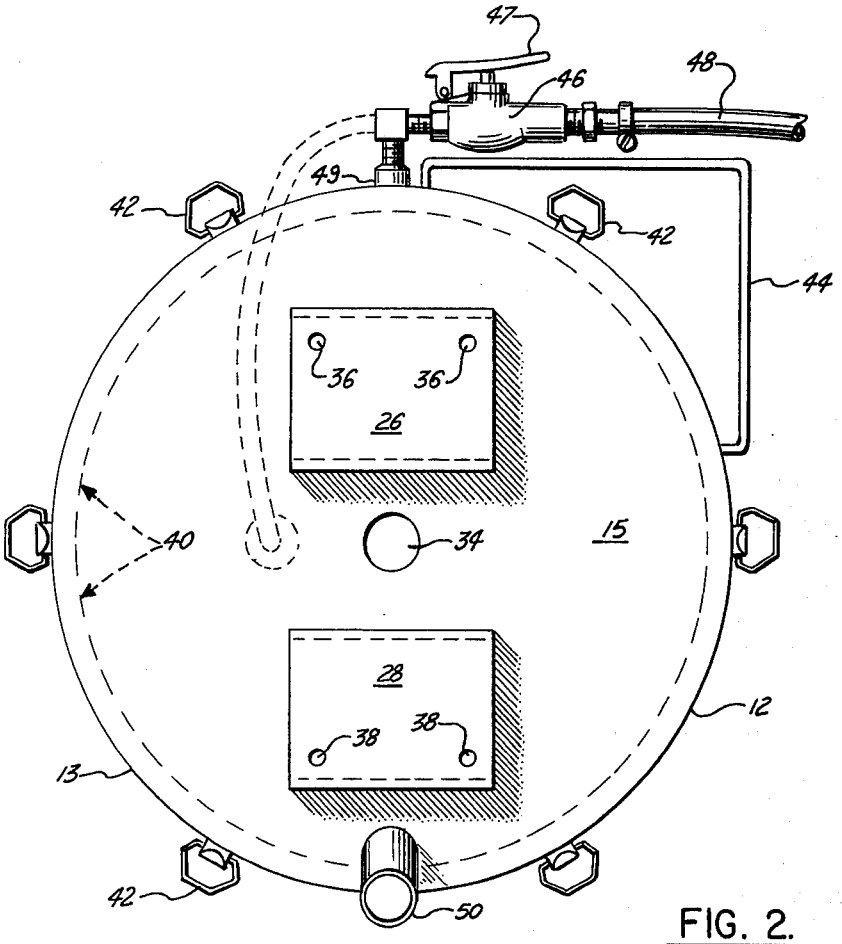
FIG. 2 is a rear view of the shroud portion of the preferred embodiment of the apparatus of the present invention.
Figure 3:
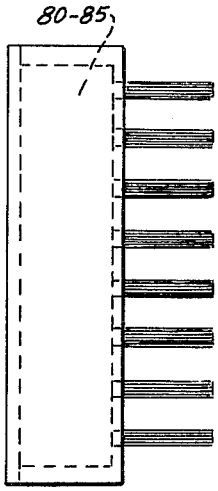
FIG. 3 is a side view of a typical brush as used with the present invention.
Figure 4:
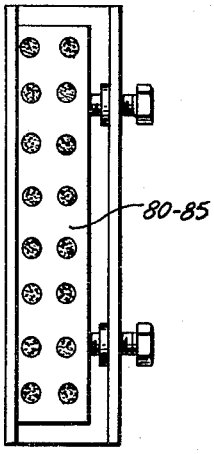
FIG. 4 is a front view of the brush and channel carriage portion of the preferred embodiment of the apparatus of the present invention.
Figure 5:
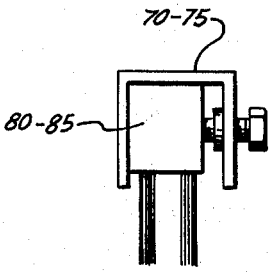
FIG. 5 is an end view of the channel and brush arrangement of FIGS. 3 and 4.

An inspection of FIGS. 1 and 2 illustrates further the connection of gun 14 to shroud 12 by showing an opening 34 through which shaft extension 23 passes. Brackets 26, 28 each are provided with openings 36, 38 for the attachment of bolts 30, 32 therethrough and the subsequent connection of wing nuts 25 thereto. Similar openings 19 are seen on flanges 22, 24 for the passage of bolts 30, 32 therethrough. A second handle 44 is provided which is mounted upon shroud 12 as best seen in FIG. 2. Mounted adjacent handle 44 is valving member 46 which provides a valve actuator 47 and to which valve 46 is attached conduit 48 which supplies a source of cleaning fluid to shroud 12. It should be understood that the connection of valve 46 to shroud 12 as shown in FIG. 2 includes a continuous inner bore through which fluid can flow from a source of cleaning fluid and a pump, for example, through valve 46 and into the inside of shroud 12 through a provided opening at connection 49.

A drain 50 allows spent fluid to drain from shroud 12 as new solution is added at 49. Drain 50 can be equipped with check valve CV and a source of compressed air to aid in removal of accumulated fluid in drain hose H. Air could be added using a hand actuated valve (not shown) such as valve 46 and handle 47 which admit fluid.

Shroud 12 provides a plurality of clamps 42 which can affix cover 40 thereto sandwiching rubber like seal 52 between cover 40 and shroud 12 as is desirable. Rubber-like seal 52 would have an opening through which a section of drill pipe 11 could pass as is best seen in FIG. 1. The opening would preferably be of a diameter substantially equal to the external diameter of drill pipe joint 11 and would form a rough seal therewith. This would insure excessive loss of fluid when carriage 60 was rotating at a high speed to clean the pin connection of joint 11.

As seen in FIGS. 1 and 2, shroud 12 includes a cylindrical wall 13 and is connected at its rear to baffle plate 15.

A brush carriage 60 would be mounted on shaft extension 23 by threading bolt 27 thereon with extension 23 passing through opening 62 of brush carriage 60. Brush carriage 60 is best seen in FIGS. 1, 6 and 7.

In this manner, it can be seen that brush carriage 60 is connected to and rotates with drive shaft 21 and shaft extension 23 responsive to actuation of gun 14 by means of trigger 18. Thus, the operator could with one hand control the operation of brush carriage 60 and its rotation by means of trigger 18 while with his other hand grip handle 44 and control the flow of cleaning fluid into shroud 12 using valving handle 47.

Figure 6:
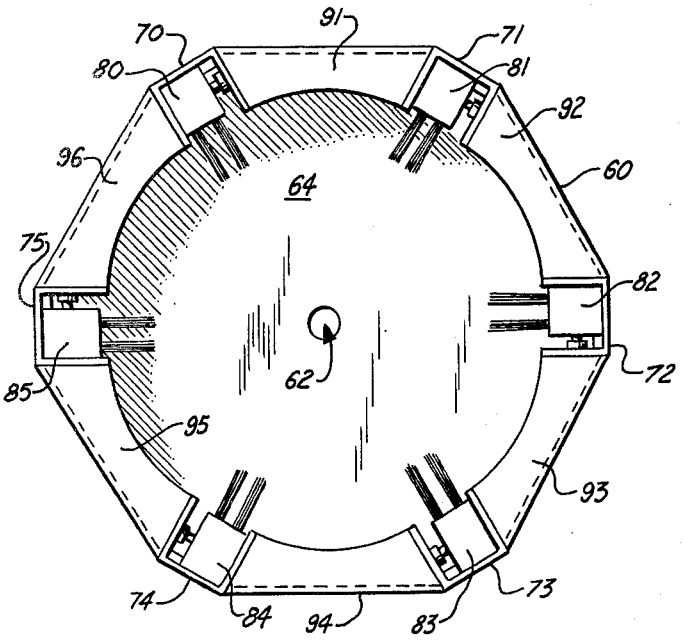
FIG. 6 is an end view of the brush carriage portion of the preferred embodiment of the apparatus of the present invention.

Brush carriage 60 provides a rearmost hub 64 to which are connected a plurality of channels 70–75 which are equi-radially spaced thereabout as shown in FIG. 6. In the preferred embodiment, six brushes are shown which are spaced at sixty degrees with respect to one another with the flanges of the channel being directed toward opening 62 and the central axis of shaft 23. It should be understood, that in the preferred embodiment a common axis would be provided for shaft 21, shroud 12, brush carriage 60, and openings 34, and 62.

Figure 7:
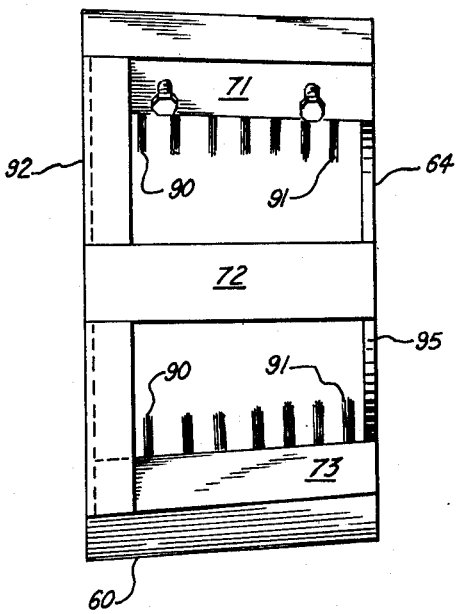
FIG. 7 is a side view of the brush carriage of FIG. 6.

In FIG. 7, it can be seen that the plurality of channels 70–75 are angled with respect to hub 64 and would eventually intersect the axis of shaft 23 if they were extended far enough. Thus each is beveled with respect to hub 64. In this manner, each brush 80–85 with its bristles 90, 91 would be beveled in a manner which would register the tips of each of the bristles 90, 91 with the angularly beveled threads T of a pin connection on joint 11 as is best seen in FIG. 1.

Bristles 90 proximate hub 64 would be further apart than the bristles 91 at the position closest from hub 64.

Gusset plates 91–96 reinforce the distal end portion (farthest from hub 64) of each channel 70–75 by forming a welded, for example, connection between the adjacent flanges of each channel as best seen in FIG. 6.

Figure 8:
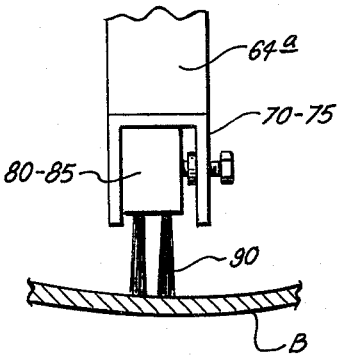
FIG. 8 is a fragmentary view of a brush as shown during the cleaning of the box end portion of a section of drill pipe.
Figure 10:
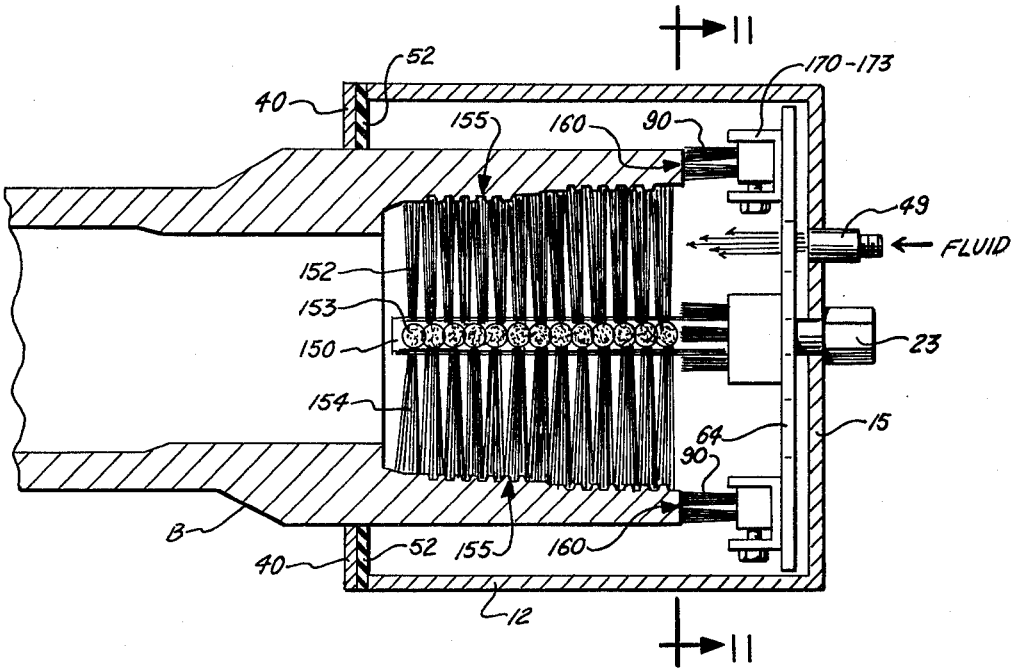
FIG. 10 is a sectional side view of the preferred embodiment of the apparatus of the present invention during the cleaning the box end portion of a section of drill pipe.

FIG. 8 shows an alernate arrangement where hub 64*a* would be used which would be a hub having an outwardly facing plurality of channels 70–75 useful in the cleaning of box end connections as seen in FIG. 10. In FIG. 8, the internal wall of box end connection is schematically indicated as the letter B.

Figure 9:
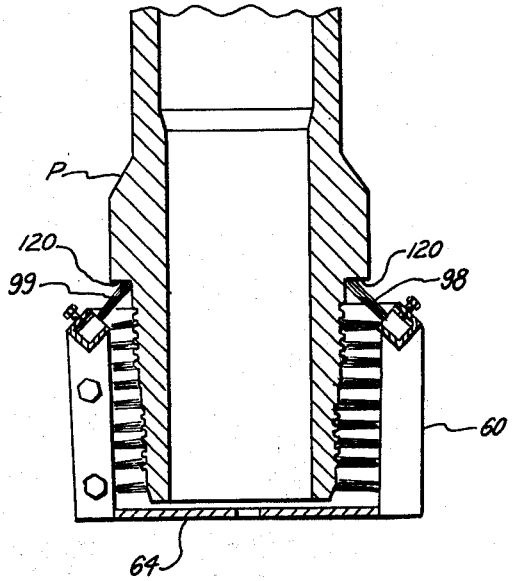
FIG. 9 is a schematic view illustrating the brush carriage cleaning the pin end portion of a section of drill pipe.

FIG. 9 shows another arrangement of carriage 60 wherein angularly placed brushes 98, 99 are affixed by welding, for example, to gusset plates 92–97. These bristles would provide a cleaning action against the face portion 120 of pin connection P.

Figure 11:
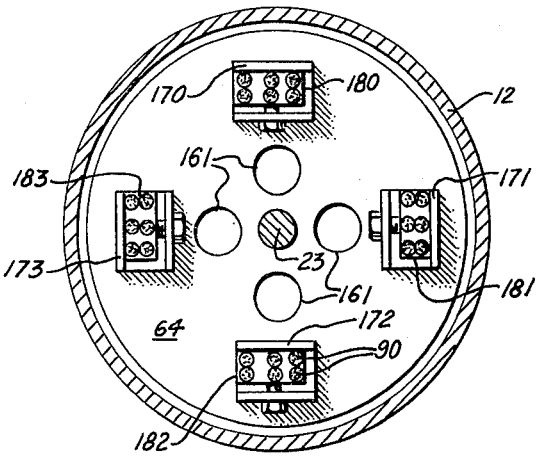
FIG. 11 is a sectional view taken along lines 11—11 of FIG. 10.

In FIGS. 10 and 11 there can be seen another embodiment of the apparatus of the present invention useful in the cleaning of box end B connections. The inner surface 155 of box end connection B is seen as well as the outermost face 160. These surfaces are generally at right angles to one another and will be the surfaces cleaned by bristles 90 and 152–154 respectively. Drive shaft 23 likewise provides a hub 64 supporting a plurality of channels 170–173, each channel housing respectively a brush 180–183 having bristles 90 thereon. These channels 170–173 are radially spaced about hub 64 in a equi-radial and equi-distant fashion from the central axis of shaft 23 (see FIG. 11). This provides continuous registration by each brush with face 160 of box connection B as is desirable. Rotation of shaft 23 by means as shown in FIG. 1 will produce a continuous scouring of face 160. Simultaneously, bristle shaft 150 and its radially spaced bristles 152–153 scour box connection threads 155 as best seen in FIG. 10.

A rubber-like seal 52 and cover 40 is achieved in the same way with respect to FIG. 1.

Fluid is introduced through the rear portion of shroud 12 at inlet 49 with a plurality of openings 161 being provided in hub 64, as seen best in FIG. 11, through which fluid can flow as schematically shown in FIG. 10.

Rotary gun 14 would be commercially available, being a pneumatically operated gun while flanges 22, 24 would be aluminum, steel or the like, while shroud would be of a metallic or like material such as stainless steel, aluminum or the like. Brush carriage 60 would be similarly be constructed of aluminum, stainless steel or the like. Seal 52 could be constructed of any suitable flexible material such as rubber, neoprene, plastic or the like.

Clamps 42 would likewise be of a suitable metallic construction such as stainless steel, aluminum, or the like. Brush carriage channels 70–75 would be strong and metallic such as aluminum or stainless steel while individual brushes 80–85 would be wooden having wire bristles mounted therein.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A hand held power brush pipe thread cleaner comprising:

a. a rotary gun having a rotary power shaft, a handle for gripping, and a trigger proximate said handle for actuating said shaft to rotate;

b. a circular baffle plate mounted securely to said gun and having an opening therethrough through which said rotary shaft passes at least in part during operation with some clearance allowing rotation of said shaft with respect to said plate;

c. a cylindrical shroud affixed to the periphery of said baffle plate forming therewith a closed end portion of said shroud adjacent said gun, the opposite end of said shroud being an open end portion thereof;

d. fluid inlet means mounted on said shroud handle for receiving a supply of flowing cleaning fluid to be dispensed into said shroud;

e. seal means removably placed over said shroud at the open end portion thereof, and having a central opening through which the threaded end of a joint of pipe to be cleaned can pass the opening approximating the outer diameter of a joint of pipe to be cleaned for forming a seal about a joint of pipe to be cleaned so that cleaning fluid is retained within the shroud; and f. a structurally integral brush carriage mounted securely yet removably to said shaft for rotation therewith, said carriage comprising:

i. a generally circular hub having a hub opening to which said shaft attaches during operation;

ii. a plurality of inwardly facing brush holding structural channels each having a channel web and a pair of channel flanges defining a recess for carrying brushes, the channels being rigidly secured radially about the periphery of said hub and being mounted at one end to the hub with the channel recesses facing the shaft; and iii. means for structurally supporting the channels at a position spaced from the hub including a plurality of gussets rigidly connecting webs of adjacent channels, each gusset being spaced from the surface of the baffle plate.

2. The apparatus of claim 1 wherein said rotary gun is pneumatically operable.

3. The apparatus of claim 1 wherein the fluid inlet means is a hand-operable valve positioned adjacent the shroud handle.

4. The apparatus of claim 1 wherein each of said channels is equipped with means for removably clamping said bristles respectively therewithin.

5. The apparatus of claim 1 further comprising discharge means on the shroud for removing fluid from the shroud.

6. The apparatus of claim 1 wherein the baffle plate is perpendicularly affixed to said gun rotary power shaft.

7. A power brush pipe thread cleaner, comprising:

a. rotary power means having a driven power shaft;

b. brush carriage means which can be removably secured to the shaft comprising:

i. a hub;

ii. a plurality of radially spaced elongated channels secured at one end to the periphery of the hub;

iii. means for holding brushes in the channels;

iv. annular gusset means for structurally connecting the ends of the channels opposite the hub so that (1) radial deflection of the channels with respect to the shaft is prevented by the hub and by the gusset means, and (2) the gusset means defines an opening through which pipe threads to be cleaned can enter the brush carriage, the hub, channels, and gusset means forming in combination a structurally integral, removable brush carriage;

c. shroud means surrounding the brush carriage; and d. a shroud opening on the shroud means which registers with the annular gusset means during operation.

8. The apparatus of claim 7, wherein the plurality of channels each comprises a channel web and a pair of connected flanges, the flanges of a plurality of the channels facing the axis of the power shaft.

9. The apparatus of claim 7, wherein each of the channels is welded at one end to the hub and at its other end to the annular gusset means.

10. The apparatus of claim 7, wherein the annular gusset means includes a curved surface connecting each channel to define a generally circular opening through which a threaded pipe joint can enter the brush carriage.

11. The apparatus of claim 7, wherein the gusset means includes a second plurality of annularly placed brush carrying channels, each attached to and spanning between the ends of the first plurality of channels.

* * * * *